US005855587A

United States Patent [19]

Hyon et al.

[11] Patent Number: 5,855,587

[45] Date of Patent: Jan. 5, 1999

[54] HOLE FORMING DEVICE FOR PIERCED EARRINGS

[75] Inventors: Chong-ik Hyon, Mt Laurel, N.J.; Jung-Haeng Lee, Bucheon, Rep. of Korea

[73] Assignee: Chon-Ik Hyon, Mt. Laurel, N.J.

[21] Appl. No.: 701,712

[22] Filed: Aug. 22, 1996

[30] Foreign Application Priority Data

Jun. 13, 1996 [KR] Rep. of Korea ..... 1996 15749

[51] Int. Cl.[6] ..... A61B 17/34

[52] U.S. Cl. ..... 606/188; 606/184

[58] Field of Search ..... 606/184, 185, 606/186, 188

[56] References Cited

U.S. PATENT DOCUMENTS

| | | | |
|---|---|---|---|
| 234,881 | 11/1880 | McAlpine | 606/188 |
| 2,713,863 | 7/1955 | Handerson | 606/188 |
| 3,527,223 | 9/1970 | Shein | 606/188 |
| 4,030,507 | 6/1977 | Mann | 606/188 |
| 4,067,341 | 1/1978 | Ivey | 606/188 |
| 4,120,303 | 10/1978 | Villa-Massone et al. | 606/188 |
| 5,016,369 | 5/1991 | Parry | 606/188 |
| 5,651,791 | 7/1997 | Zavlodaver | 606/188 |

*Primary Examiner*—Michael Buiz
*Assistant Examiner*—Daphna Shai

[57] ABSTRACT

The present invention relates to a hole forming device for pierced earrings which comprises a body of an earring including a pin member which has a tapered end part and penetrates an ear and an ornamental member integrally connected to the other end part of the pin member which is exposed on the front side of the ear; a clip for gripping the end part of the pin member behind the ear; and a guide member having a through hole and a projecting part at one end toward the front side of the ear.

The present invention provides a hole forming device for pierced earrings whereby various earrings can be replaced and users' various desires can be satisfied even while a hole is being formed.

5 Claims, 2 Drawing Sheets

HOLE FORMING DEVICE FOR PIERCED EARRINGS

[FIELD OF THE INVENTION]

The present invention relates to a hole forming device for pierced earrings, in particular, to a hole forming device for pierced earrings whereby various kinds of earrings are to be replaced even while forming holes in ears, thus maximizing their ornamental effect and satisfying users' diverse desires.

[DESCRIPTION OF THE PRIOR ART]

General earrings are divided into two types, i.e., clip-on earrings and pierced earrings according to the methods of wearing them. For the installation of the pierced earring, a hole should be formed in the ear.

Conventionally, in order to have the ear pierced, a gun for forming a hole for the pierced earring discharges a sharp forming body aiming at a target spot on the ear and the forming body penetrates the ear to settle down through the target spot.

As shown in FIG. 1, a conventional hole forming device comprises a main body 10 and a clip 20. The main body 10 includes a pin member 11 which has a tapered end part and penetrates an ear 1 and an ornamental member 12 at the other end of the pin member 11 which is exposed on the front side of the ear.

The ornamental member 12 prevents the main body 10 from being released from the ear and decorates the whole hole forming device, so that it has the same effect as in the state where an actual earring is installed, while the main body is kept penetrating the ear for 4 or 6 weeks until the hole is completely formed.

The clip 20 grips and fixes the end part of the pin member 11 behind the ear 1 to prevent the pin member 11 from being released from its position.

The clip 20 is fitted into a groove 13 which is formed concavely at the end of the pin member 11.

According to the above-structured hole forming device, however, the main body 10 must not be separated and released from the clip 20 until the hole is completely formed. This is because earrings can be replaced according to a user's preference only after the pierced hole is formed irreversibly by the continuous action of external force by the pin member 11 of the main body 10. Accordingly, the main body 10 must be maintained penetrating the ear for a comparatively long period of 4 to 6 weeks, so that the ornamental member 12 has no choice but to maintain only one design since the member 12 is an integral component of the main body 10.

The size and design of the ornamental member 12 is to be limited to one kind, taking into consideration of the size of bullets with which the gun for piercing ears is to be charged.

The conventional hole forming device has disadvantages that the ornamental effect can be little expected by the limitations of size, design and time, and it cannot satisfy users' desires for diversity and change.

[SUMMARY OF THE INVENTION]

It is an object of the present invention, therefore, to provide a hole forming device for pierced earrings whereby various earrings can be replaced even while a hole is being formed.

It is another object of the present invention to provide a hole forming device for pierced earrings whereby various earrings can be replaced and users' various desires can be satisfied even when a hole forming device is installed through an ear.

[DETAILED DESCRIPTION OF THE INVENTION]

The hole forming device according to the present invention comprises:

- a body of an earring including a pin member which has a tapered end part and penetrates an ear and an ornamental member integrally connected to the other end part of the pin member which is exposed on the front side of the ear;
- a clip for gripping the end part of the pin member behind the ear; and
- a guide member having a through hole for the insertion of the pin member therethrough and a projecting part at an end toward the front side of the ear to prevent the guide member from being released from the ear.

The hole forming device of the present invention further comprises the guide member through which the body of an earring is inserted, differently from the conventional hole forming device.

According to the hole forming device of the present invention, both the body of an earring and the guide member penetrate the ear simultaneously, so that the body can be replaced with another whenever users wish just by releasing the internal body of an earring from the external guide member. Therefore, for the long period until a hole for a pierced earring is completely formed, earrings having various sizes, designs and colors can be changed as much as users desire.

With reference to the accompanying drawings, preferred embodiments of the present invention will be explained in detail.

[DETAILED DESCRIPTION OF THE PREFERRED EMBODIMENTS OF THE INVENTION]

Figure 1:
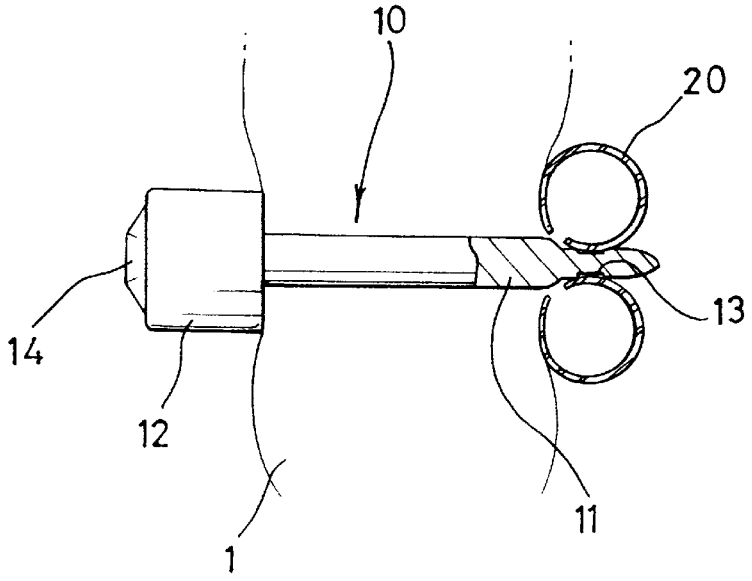
FIG. 1 PRIOR ART
FIG. 1 is a cross sectional view of the conventional hole forming device.
Figure 2:
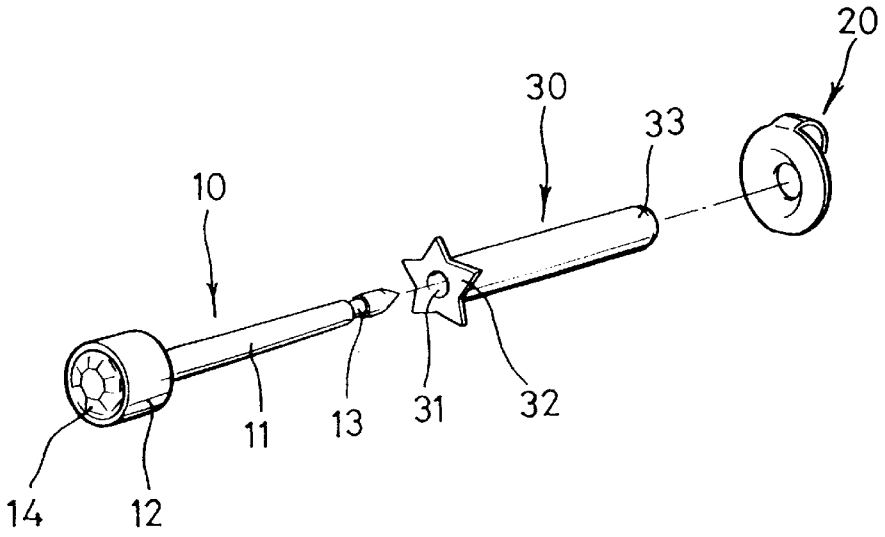
FIG. 2 is a separated perspective view showing the components of the hole forming device according to the present invention.

FIG. 2 shows a body of an earring 10, a guide member 30 and a clip 20 which are to be assembled in sequence.

The body of an earring 10 comprises a pin member 11 elongated by the length enough to penetrate the ear and an ornamental member 12 connected integrally with an end of the pin member 11 and exposed on the front side of the ear.

Figure 3:
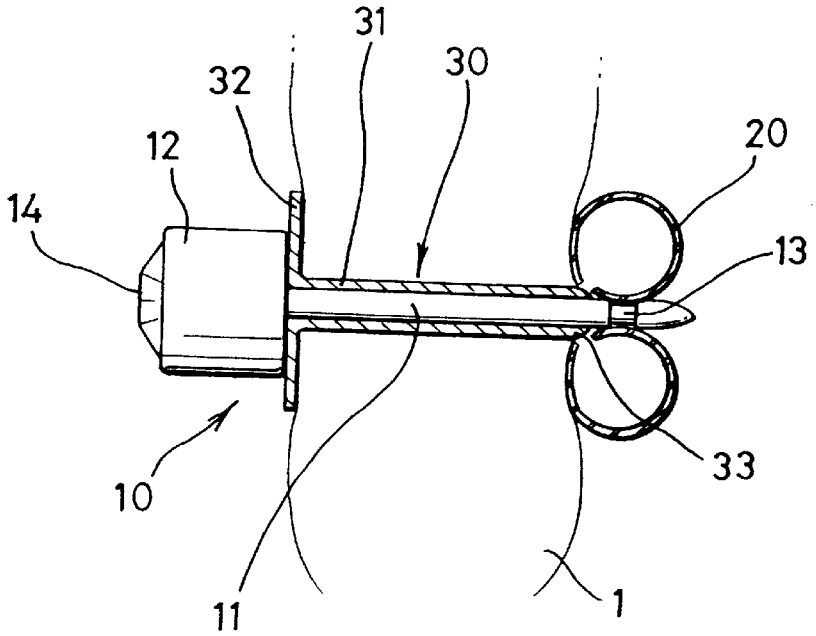
FIG. 3 is a cross sectional view showing an assembled state of the hole forming device according to an embodiment of the present invention.
Figure 4:
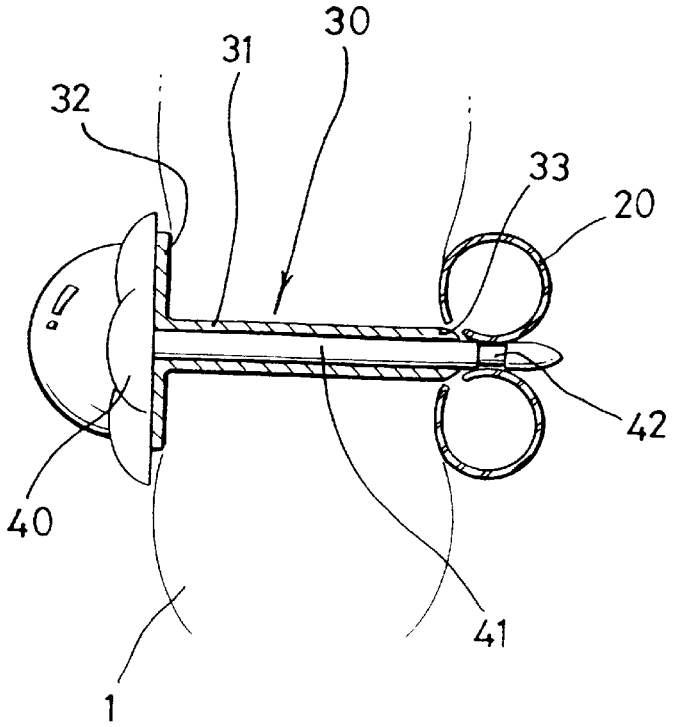
FIG. 4 is a cross sectional view showing the hole forming device according to another embodiment of the present invention.

The pin member 11 in FIGS. 2 and 3 has the substantially same diameter as the fixing pin 41 of a usual earring 40 of FIG. 4 and is formed to have enough length to be connected with the clip 20 at its end part behind the ear. Additionally, the end of the pin member 11 is formed sharply so that the pin member 11 may penetrate the ear easily and rapidly without causing pain when the body of an earring 10 is discharged from a gun for piercing the ear (not shown).

The pin member 11 includes a groove 13 at its end part to prevent the clip 20 or the body of an earring 10 from slipping away and being released from the ear.

In the meantime, the ornamental member 12 is formed integrally with the pin member 11 and shows an ornamental effect on the front side of the ear, so that jewelry or imitation jewelry 14 may be attached to the front side of the ornamental member 12.

The body of an earring 10, in particular, its pin member 11 coupled with the guide member 30 through the hole 31 which has an inner diameter corresponding to the outer diameter of the pin member 11. The through hole 31 has the inner diameter in order for the guide member 30 to be coupled with and disassembled from the pin member 11 by the action of a little force suitable for the transition fit between the guide member 30 and the pin member 11.

The guide member 30 has a projecting part 32 at the end toward the front side of the ear to prevent the guide member 30 from being released from the ear. When the pin member 11 and the guide member 30 are integrally discharged from the gun for piercing the ear, and when the members 11 and 30 are put on the ear, the projecting part 32 keeps the guide member 30 at its fixed position.

FIG. 3 shows the assembled structure of the body of an earring 10, the guide member 30 and the clip 20 in FIG. 2. When a user become bored with the designs of the ornamental member 12 and the imitation jewelry 14, the user may just grip and pull the ornamental member 12 with a little external force with one hand and grip the clip 20 with the other hand. Then the clip 20 becomes disassembled from the pin member 11 and the body of an earring 10 is separated from the guide member 30.

In this case, only the guide member 30 maintains its own position, and only the projecting part 32 of the guide member 30 is exposed on the front side of the ear. Accordingly, if the projecting part 32 is designed to show esthetic value as shown in FIG. 2, the guide member 30 can exhibit ornamental effect like the ornamental member 12 even after the body of an earring 10 is separated from the guide member 30. FIG. 2 shows a star-shaped projecting part 32 as an example. Various designs such as heart, flowers, musical instruments and so forth may be applied to the projecting part 32.

In FIG. 3, the projecting part 32 is formed to be larger than the ornamental member 12, and in that case the design of the projecting part 32 functions as an external outline or a ground design of the ornamental member 12 when the whole members of the hole forming device are assembled.

Since the guide member 30 is discharged from the gun for piercing an ear together with the body of an earring 10, the contact area of the hole forming device with the ear increases and the pain due to the penetration decreases.

The most important structural feature of the present invention is that the hole forming device further comprises the guide member 30 which maintains its original position until the hole for the pierced earring is completely formed in the ear and enables the body of an earring 10 to be replaced by another.

FIG. 4 shows the state where an earring 40 having different design from the ornamental member 12 of the body 10 is substituted for the body 10 while the guide member 30 remains unchanged. Various earrings can be replaced continuously during the formation of the hole, just by separating and removing the body 10 from the guide member 30, inserting the pin 41 of the earring 40 into the through hole 31 of the guide member 30, and then gripping the groove 42 by the clip 20 behind the ear.

Meanwhile, it is important to form the guide member 30 using the materials which are not noxious to skin since the guide member 30 should maintain its position through the ear for a comparatively long period. Gold and silver are preferable as the materials of the guide member 30 since they are harmless to human body and cause no allergy. Stainless steel or synthetic resins which are harmless to skin can be also used as the materials of the guide member 30.

The guide member 30 has the projecting part 32 at one end and is preferable to have the other end part 33 tapered sharply so that the guide member 30 and the body of an earring 10 may penetrate the ear smoothly.

The hole forming device for pierced earrings according to the present invention provides the users with extensive choices by the ornamental member 12 of the body of an earring 10 even before the hole for the pierced earrings is completely formed.

The present invention can provide the users with much more choices by the various designs of the projecting part 32 of the guide member 30 together with or without the ornamental member 12 of the body 10.

The hole forming device of the present invention is very useful in that the ornamental effect as an earring can be maximized and the desires of the users for rapid change and diversity can be satisfied.

Those skilled in the art will readily recognize that various other modifications and changes may be made to the present invention without strictly following the exemplary application illustrated and described herein and without departing from the true spirit and scope of the present invention, which is set forth in the following claims.

What is claimed is:

1. A hole forming device for pierced earrings comprising:

(a) a body of an earring including a pin member that has a first end and a second end, (i) said pin member first end being tapered to a sharp point which is adapted to cleanly penetrate through the flesh of a human ear to pierce a hole therein, (ii) said pin member first end having a groove proximate said pin member sharp point, said groove being configured to receive and engage a clip for holding said pin member in place on a human ear, (iii) said pin member second end having an ornamental member integrally connected thereto so that said ornamental member may be exposed for display on the front side of the ear when said pin member is placed into a pierced hole in the ear;

(b) a clip for engaging and gripping said groove; and (c) a guide member having a through hole, a sharply tapered and rounded end and a projecting part, at its other end, toward the front side of the ear;

whereby said sharply tapered and rounded end and said sharp point interally and simultaneously penetrate the ear to form a hole therein; and wherein said guide member remains in the ear until the hole for the pierced earring is completely formed.

2. A hole forming device as recited in claim 1 wherein said clip has a centrally-located hole through said clip such that said pin member first end may project through said clip hole so that said clip may engage and grip said pin member groove.

3. A hole forming device as recited in claim 2 wherein said projecting part of said guide member is adapted to abut against said ornamental member.

4. A hole forming device as recited in claim 2 wherein said guide member is adapted to retain a freshly pierced hole in an ear for a period of weeks while the hole heats and achieves a stable configuration.

5. A hole forming device as recited in claim 4 wherein said earring may be repeatedly removed from said guide and replaced with another earring of the wearer's choice, enabling the wearer to readily select different ornamental members for display on the ear during the period of time required for the hole to heal.

* * * * *